US005303539A

United States Patent [19]

Neamtu

[11] Patent Number: 5,303,539

[45] Date of Patent: Apr. 19, 1994

[54] STAPLE FORMING

[75] Inventor: Nicolae Neamtu, Quincy, Mass.

[73] Assignee: The Gillette Company, Boston, Mass.

[21] Appl. No.: 11,446

[22] Filed: Jan. 29, 1993

[51] Int. Cl.[5] ..... B21G 7/02

[52] U.S. Cl. ..... 59/75; 59/72; 59/77

[58] Field of Search ..... 59/71, 72, 73, 74, 75, 59/76, 77; 227/86, 95

[56] References Cited

U.S. PATENT DOCUMENTS

| | | | |
|---|---|---|---|
| 1,746,496 | 2/1930 | Palmgren | 227/86 |
| 1,761,640 | 6/1930 | Palmgren | 227/86 |
| 2,174,708 | 10/1939 | Sears et al. | 227/86 |
| 2,431,812 | 12/1947 | Lang | 59/72 |
| 3,151,443 | 10/1964 | Sitzler | 59/77 |
| 3,805,356 | 4/1974 | Serrano | 227/86 |
| 4,066,165 | 1/1978 | Ruskin | 59/75 |

*Primary Examiner*—David Jones

*Attorney, Agent, or Firm*—Aubrey C. Brine; Donal B. Tobin; Paul I. Douglas

[57] ABSTRACT

A flat clip or staple is manufactured from a continuous strip of flat sheet material in coil form by first stamping out intermediate portions of material between each of the blanks to be formed into a discrete staple while retaining the blanks in the continuous strip. The strip is then subjected to a second stamping process where each discrete staple is severed from the strip, formed into the required shape and the excess waste material removed from the continuous strip. The second stamping process is located immediately adjacent the final stapling assembly operation, such that the staples never need to be transported to the final stapling operation site in separated form.

10 Claims, 4 Drawing Sheets

STAPLE FORMING

BACKGROUND OF THE INVENTION

The present invention relates to a flat clip or staple and more particularly to employment of a strip of flat material in coiled form, and the machine and process employed, to provide a staple for the attachment of articles.

Many of the manufactured articles currently provided on the market comprise elements which are fastened by staples or staple-like clips. In the manufacture of such articles by mass production techniques, it is necessary to introduce the staple or staples into the process in single form and thereafter present the staple to the articles to be fastened at some point in the manufacturing process where clinching of the staple takes place.

Generally the staples are manufactured and packaged in single form in an area remote from the assembly process. From this point the staples are transferred to the assembly area and are fed into the assembly line one at a time, for attachment of the manufactured article. In order to introduce the staples into the manufacturing process they may, for example, be deposited into a vibrating chamber, or other means which is effective, to align them into a form where they may be introduced singly to a subsequent clinching operation. Another common way to introduce the staples into the manufacturing process is, of course, in long clips of 50 to 200 staples wherein the independent staples have previously been lacquered together. These long clips of staples have traditionally been used in hand held staplers such as used to join the pages of business and commercial documents.

It has been found that in the packaging, transporting, and subsequent feeding of these long clips or the intermingling of the staples, such as that which occurs in a vibrator device, the staples may be deformed or otherwise rendered inadequate for use in the assembly process, due to the required handling of the staples prior to the clinching operation. Therefore, a problem of waste exists in the process described above, as many of the staples are incapable of use in the subsequent clinching operation.

It is therefore an object of the present invention to provide a clip or staple which is retained in strip form during its manufacture and until just prior to the clinching process.

A further object of the invention is to provide a clip or staple which may be stored or retained in coil form during its manufacture.

Another object of the invention is to provide a method of manufacturing a clip or staple wherein the clip or staple is subjected first to an initial forming process while retained in strip form and thereafter severed from the strip prior to introduction into a manufacturing process.

Yet another object of the invention is to provide apparatus for manufacturing an array of clips or staples in strip form.

Still a further object of the invention is to provide a method of assembling articles which employs a strip having an array of clips or staples provided in planar form, disposed along the length of the strip.

SUMMARY OF THE INVENTION

The above objects and other objectives which will become apparent as the description proceeds are achieved by the manufacture of a staple which includes the steps of first providing a strip of flat material in coiled condition and thereafter unwinding a length of the coil and removing portions of the strip from the unwound length to produce an array of staples in flat planar form which are interconnected. The flat strip of staples is then rewound to produce a second coil. The second coil is thereafter unwound and the staples are severed from the strip and bent about a continuous rail having a die portion, to form a substantially U-shaped staple which is retained on the rail and moved to the point at which the staple is set, to operatively engage articles of manufacture.

The array of staples in planar form when in the second coil is interconnected at an outer edge of the strip to retain each staple until separated from the strip and the strip of flat material in coiled condition is generally of aluminum and may be in the area of 0.015 inches in thickness.

The apparatus for producing the staples generally consists of means for feeding a strip of flat material into the apparatus and first stamping means for removing portions of the strip to produce an array of interconnected staples in flat planar form along the length of the strip. A second stamping means is provided for severing at least one of the staples from the strip and a die is provided about which the staple is pressed to produce a U-shaped staple from the staple in planar form. The first stamping means generally comprises a plurality of punches in spaced relation along the strip, each of the punches forming at least one side of a staple in planar form and the die provided is in the form of a continuous rail for supporting the staples in alignment as the staples exit from the apparatus.

BRIEF DESCRIPTION OF THE DRAWING

Reference is made to the accompanying drawing in which there is shown an illustrative embodiment of the invention from which its novel features and advantages will be apparent wherein.

DESCRIPTION OF THE PREFERRED EMBODIMENT

Figure 1:
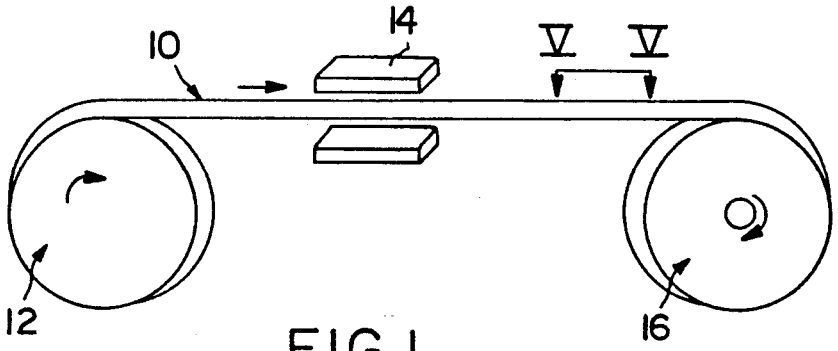
FIG. 1 is a schematic elevational view showing the initial steps in a process for forming a flat staple in accordance with the teaching of the present invention.
Figure 2:
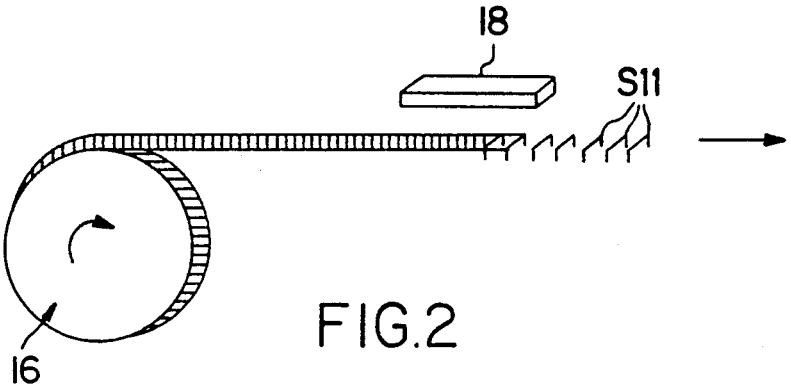
FIG. 2 is a schematic elevational view similar to FIG. 1 showing further steps in the formation of the flat staple following the steps of FIG. 1.

Referring now to the drawing and in particular to FIGS. 1 and 2 there is shown in schematic the process for producing a staple S 11 wherein a strip 10 of flat material is provided on afirst coil 12 the strip 10 travelling through a first stamping means such as first station 14 and 5 thereafter being wound into a second coil 16.

As best shown in FIG. 2, the coil 16 is then transferred by transportation means such as a wheeled dolly, or overland truck, to the point at which the staples are to be introduced into a manufacturing process and the coil is fed through a second stamping means such as second work station 18 at which point the staples S 11 are individually formed, severed from the strip 10 and clinched about the articles to be fastened by the staple. The strip 10 in the present embodiment is of aluminum material in the area of 0.015 inches in thickness, however, it should be understood that other materials of varying thickness may be employed to meet the requirements of a specific application.

Figure 3:
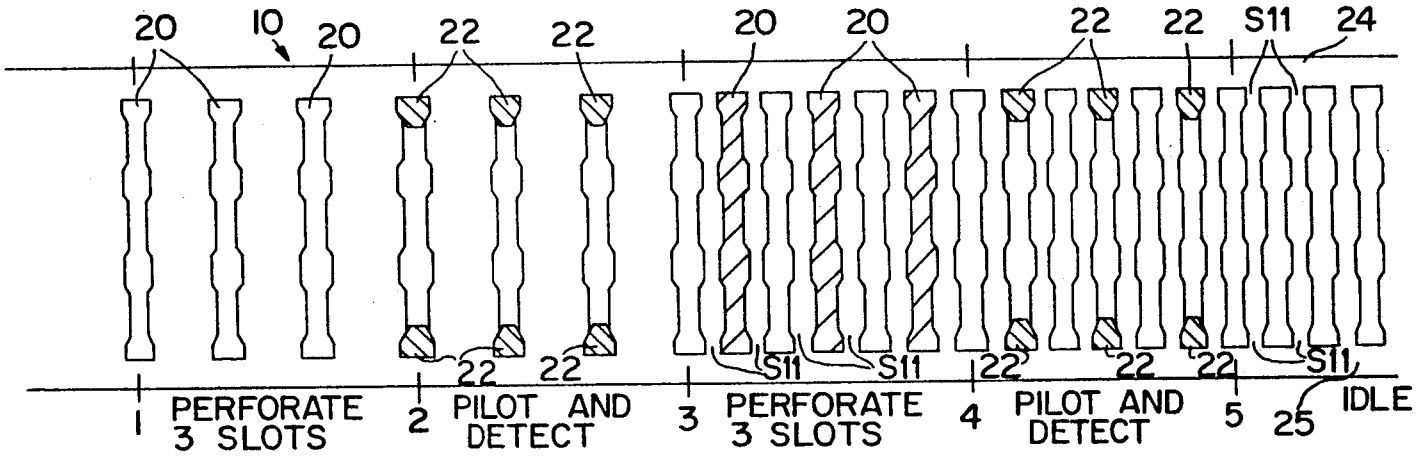
FIG. 3 is a top plan view of the flat stock material during the process shown in FIG. 1.
Figure 4:
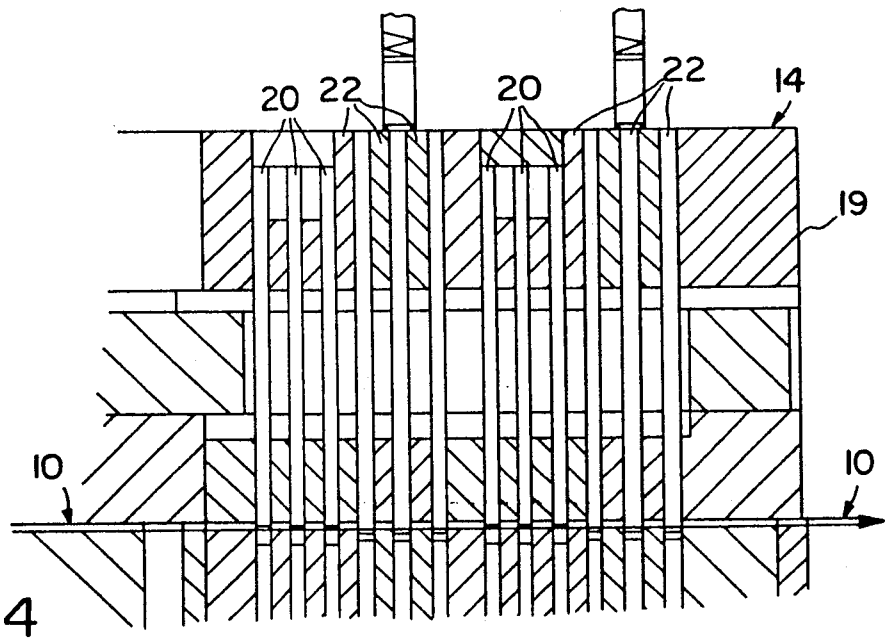
FIG. 4 is a fragmentary elevational view partially in section showing a typical device employed in the initial steps of forming a flat staple by the process of the present invention.

For details of the process at work station 14 reference should be made to FIGS. 3 and 4 where it is shown that a punch press 19 is provided with a plurality of punches 20, six in number, which are combined with six pairs of pilot rods 22. The punches 20 and pilot rods 22 are simultaneously brought into contact with, and forced to extend through the strip 10 as it is incrementally fed through the punch press 19.

Figure 5:
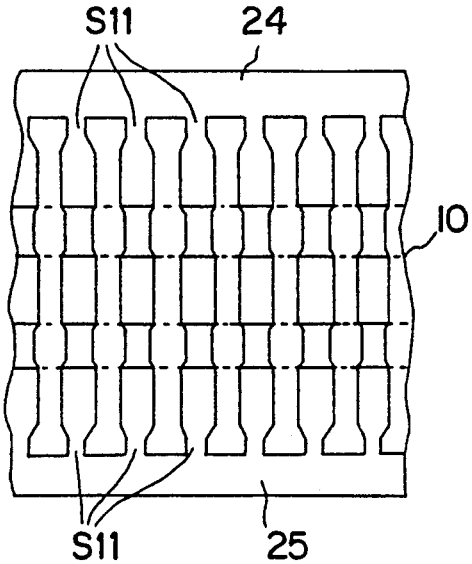
FIG. 5 is a top plan view similar to FIG. 3, taken along the line V—V of FIG. 1, showing the flat stock material employed in the further steps of staple forming depicted in FIG. 2.

Referring to FIGS. 3 and 4, the operation of the punch press 9 is shown in the four separate areas 1–2, 2–3, 3–4 and 4–5 of the strip 10. With the strip 10 in the position shown, the punches 20 are forced through the strip material to produce at least one side of a staple S 11 and simultaneously the punches 20 at the area 3–4 form at least one side of a staple S 11 as they are forced through the material. The pilot rods 22 serve to stabilize the material at both the areas 2–3 and 4–5 as the punching process takes place. The strip is then moved forward an increment equivlent to the distance of the area 1–2, which is equal to the distance of each of the areas 2–3, 3–4 and 4–5, and the punches 20 stamp material from the strip 10 to form sides of a new set of staples while the pilot rods 22 in the area 2–3 retain those stamped out portions previously located in the area 1–2. The punches 20 in the area 3–4 simultaneously remove material from between those punched out portions of the strip previously contained in the area 2–3 and an array of staples S in planar form is produced. Each of the staples S in planar form are retained between opposite edges 24 and 25 of the strip 10 thereby allowing the strip 10 to be recoiled into coil 16, as was described with regard to FIGS. 1 and 2. A portion of the strip 10 as it is rolled upon the coil 16 is shown in FIG. 5 in which the array of staples S in planar form are retained between the edges 24 and 25 of the strip 10.

Figure 6:
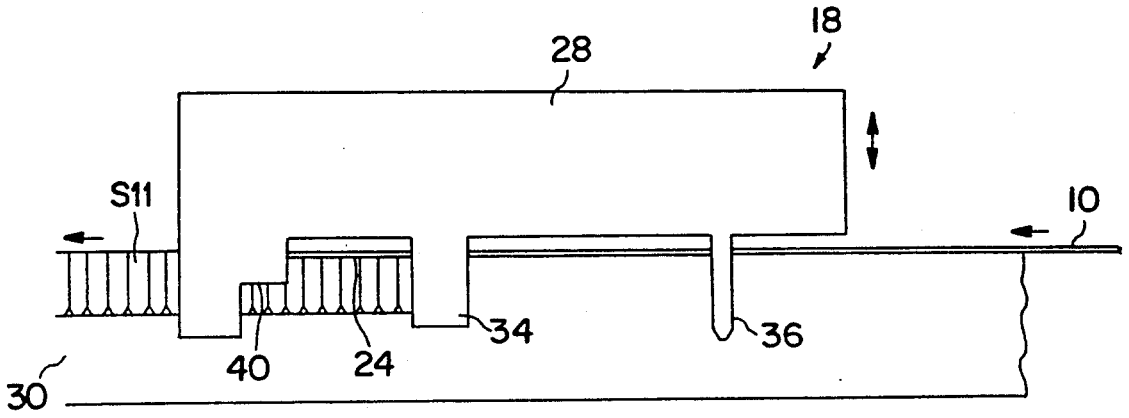
FIG. 6 is a fragmentary side elevational view showing a typical device employed in the further steps of forming a flat staple as shown in FIG. 2.
Figure 7:
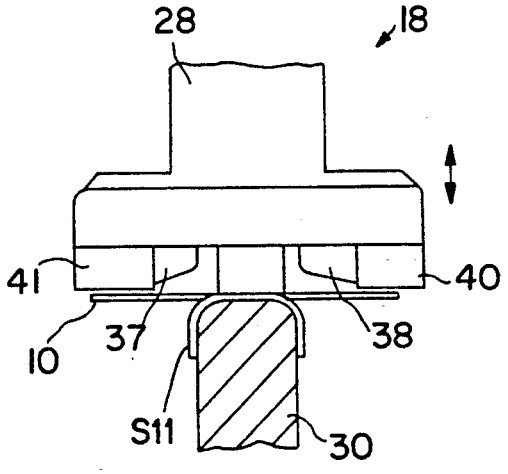
FIG. 7 is a fragmentary front elevational view showing the structure of FIG. 6 in one mode of operation.

Referring now to FIGS. 6 through 9, the work station 18 which may be advantageously located adjacent the assembly point at which the staples S are to be employed for attaching articles, comprises a forming press 28 into which the array of staples S in planar form are fed while retained on the strip 10. The forming press 28 as best seen in FIG. 6 comprises a continuous rail member 30, a severing punch 34 and a staple forming section of the same punch 34 disposed above the rail 30 (as shown in FIG. 7). The punch 34 is located above the path of the strip 10 and poised to operate on the strip 10 as it is incrementally fed through the forming press 28. A pilot member 36 which may comprise rods similar to the rods 22 is located at a position along the path of the strip 10 prior to the forming punch 34 to aid in locating and stabilizing the strip 10 as it is retained in the press 28. Each of the elements, severing punch 34, staple forming section of punch 34 and pilot member 36 are actuated simultaneously, being lifted above the strip 10 as it is incrementally fed, and being forced downwardly through the strip during operation of the press 28.

Figure 8:
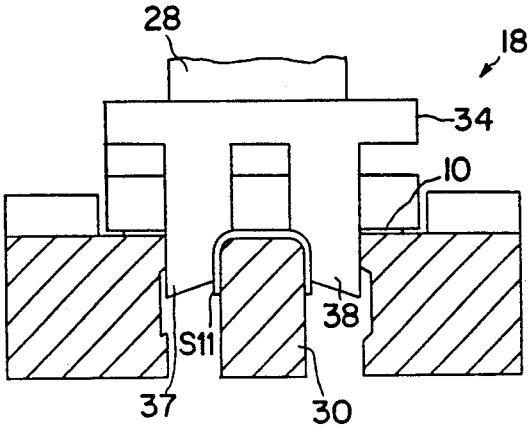
FIG. 8 is a fragmentary front elevational view similar to FIG. 7 showing the structure of FIGS. 6 and 7 during a second mode of operation.
Figure 9:
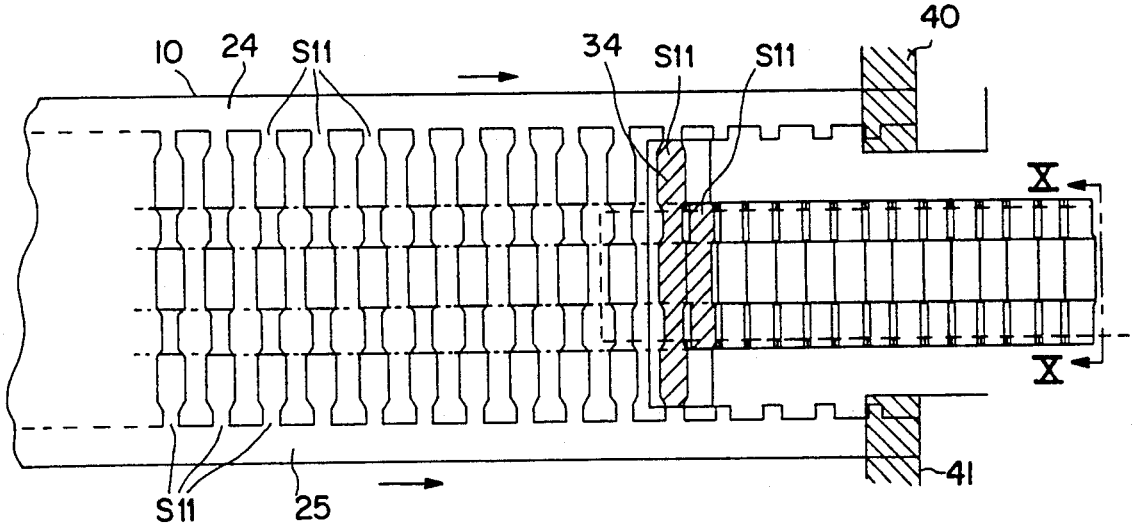
FIG. 9 is a top plan view of the flat stock showing details of the process performed by the structure of FIGS. 6 through 8.

Referring to FIGS. 7 through 9, the staple forming section of punch 34 is shown to comprise a pair of downwardly extending legs 37 and 38 (FIG. 8) which are moved from a position shown in FIG. 7 to the position shown in FIG. 8, wherein the outer edges of the legs 37 and 38 are effective to server one staple S 11 in planar form from the edge portions 24 and 25 of the strip 10 and upon further movement in the downward direction to form the staple S 11 from its planar condition into a U-shaped staple structure corresponding in configuration to the shape of the rail 30. Simultaneously with downward movement of the staple forming section of punch 34 those edge portions 24 and 25, which are disposed forwardly of the forming punch 34 are severed by the cutting edges of the punches 40 and 41 and are carried away as scrap.

Figure 10:
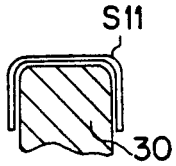
FIG. 10 is a detailed view showing the staples manufactured in accordance with the teachings of the present invention.
Figure 11:
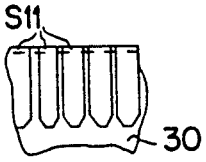
FIG. 11 is a side elevational view showing the staples of FIG. 10.

As shown in FIGS. 9, 10 and 11, the strip 10 is sequentially moved in a stepped manner through the forming press 28 and the staples S 11 are retained on, and moved along the rail 30 to a point where they are employed in a manufacturing process to fasten articles by clinching the downwardly turned portions of the staple about the articles in a known manner.

Since the coil 16 (FIG. 2) may comprise for example at least 230,000 partially formed staples, each manufacturing station that performs the stapling function is supplied with a relatively uninterrupted flow of staples. As a result, a machine operator does not have to manually feed long clips of staples to the manufacturing station and the operating manpower requirements are therefore reduced. Vibrating hoppers filled with individual staples are also eliminated, along with their attendant noise and maintenance requirements.

Further, when the feeding process employs vibratory hoppers, the staples within the vibrating hoppers vibrate against one another and generate significant quantities of metal dust that is ingested by the assembled parts and equipment located downstream of the stapling operation. By employing the staple-coil process of the present invention these problems are eliminated, and the objectives of the invention are achieved.

By keeping the staples in coiled-connected flat planar form until they are transported to the final stapling operation apparatus, wherein they are formed in their final U-shape on the same rail that transfers them to the final stapling operation, the problems inherent with handling U-shaped separated staples prior to their delivery to the rail is eliminated.

While it is apparent that changes and modifications can be made within the spirit and scope of the present invention, it is my intention, however, only to be limited by the appended claims.

As my invention I claim:

1. A method of manufacturing a staple comprising the steps of providing a strip of flat material having opposite edges, said strip being in coiled condition;

unwinding a length of said coil and removing portions of said strip from between said opposite edges of said unwound length to produce an array of at opposite ends staples in planar form interconnected one to the other at opposite edges of said coil; and rewinding said strip of staples while still in planar form to produce a second coil.

2. The method of claim 1 which includes the further steps of unwinding said second coil and severing a staple in planar form from said strip; and bending said staple in planar form about a die to form a U-shaped staple.

3. The method of claim 1 wherein said strip of flat material is in the area of 0.015 inches in thickness.

4. The method of claim 1 wherein said strip of flat material is aluminum.

5. The method of claim 1 wherein said array of staples in planar form is interconnected solely at both outer edges of said strip of flat material.

6. A method of assembling articles, said method comprising the steps of:

providing a strip of flat material having opposite edges and having an array of staples in planar form disposed along the length of the strip and interconnected at opposite ends one to the other at opposite edges of said strip;

severing at least one staple from between said opposite edges of said strip;

bending said staple to form a substantially U-shaped staple; and operatively engaging said staple with said articles.

7. The method of claim 6 wherein said array of staples is interconnected solely by both outer edges of said strip of flat material.

8. Apparatus for producing staples comprising means for feeding a strip of flat material having opposite outer edges into said apparatus;

first stamping means for removing portions of material from between the outer edges of said strip to produce an array of staples in planar form along the length of said strip interconnected at opposite ends at the outer edges of said strip; and second stamping means for severing at least one of said staples from between said opposite edges of said strip and forming said staple about a die to produce a U-shaped staple.

9. The apparatus of claim 8 wherein said first stamping means comprised a plurality of punches in spaced relation along said strip of said punches forming one side only of a pair of adjacent staples in planar form.

10. The apparatus of claim 9 wherein said die is in the form of a continuous rail for supporting the staples in alignment as the staples exit said apparatus.

* * * * *

UNITED STATES PATENT AND TRADEMARK OFFICE

CERTIFICATE OF CORRECTION

PATENT NO. : 5,303,539

DATED : April 19, 1994

INVENTOR(S) : Nicolae Neamtu

It is certified that error appears in the above-identified patent and that said Letters Patent is hereby corrected as shown below:

Title Page:

item [21]: "Appl. No.: 11,446" should read -- Appl. No.: 011,446 --

Signed and Sealed this

Sixth Day of September, 1994

*Attest:*

Bruce Lehman

BRUCE LEHMAN

*Attesting Officer*

*Commissioner of Patents and Trademarks*